United States Patent [19]

Hansen et al.

[11] Patent Number: 5,069,171

[45] Date of Patent: Dec. 3, 1991

[54] FLUIDIZED BED COMBUSTION SYSTEM AND METHOD HAVING AN INTEGRAL RECYCLE HEAT EXCHANGER WITH A TRANSVERSE OUTLET CHAMBER

[75] Inventors: Arthur M. Hansen, East Hanover; William D. Stevens, North Caldwell; Justin P. Winkin, Annandale, all of N.J.

[73] Assignee: Foster Wheeler Agency Corporation, Clinton, N.J.

[21] Appl. No.: 537,396

[22] Filed: Jun. 12, 1990

[51] Int. Cl.[5] ..... F22B 1/02

[52] U.S. Cl. ..... 122/4 D; 110/245; 431/170; 432/58

[58] Field of Search ..... 110/245; 122/4 D; 432/58; 431/170

[56] References Cited

U.S. PATENT DOCUMENTS

| | | | |
|---|---|---|---|
| 3,893,426 | 7/1975 | Bryers . | |
| 4,111,158 | 9/1978 | Reh et al. . | |
| 4,165,717 | 8/1979 | Reh et al. . | |
| 4,227,488 | 10/1980 | Stewart et al. . | |
| 4,338,283 | 7/1982 | Sakamoto et al. . | |
| 4,469,050 | 9/1984 | Korenberg . | |
| 4,594,967 | 6/1986 | Wolowodiuk . | |
| 4,617,877 | 10/1986 | Gamble . | |
| 4,665,864 | 5/1987 | Seshamani et al. . | |
| 4,682,567 | 7/1987 | Garcia-Mallol et al. . | |
| 4,686,939 | 8/1987 | Stromberg | 110/245 |
| 4,694,758 | 9/1987 | Gorzegno et al. . | |
| 4,704,084 | 11/1987 | Liu et al. . | |
| 4,709,662 | 12/1987 | Rawdon | 110/245 |
| 4,716,856 | 1/1988 | Beisswenger et al. . | |
| 4,761,131 | 8/1988 | Abdulally . | |
| 4,828,486 | 5/1989 | Sakamoto et al. | 122/4 D |
| 4,856,460 | 8/1989 | Wied et al. | 110/245 |
| 4,896,717 | 1/1990 | Campbell, Jr. et al. | 110/245 |
| 4,947,804 | 8/1990 | Abdulally | 122/4 D |
| 4,969,930 | 11/1990 | Arpalahti | 122/4 D |

*Primary Examiner*—Henry C. Yuen

*Attorney, Agent, or Firm*—Marvin A. Maigur

[57] ABSTRACT

A fluidized bed combustion system and method in which a recycle heat exchange section is located within an enclosure housing the furnace section of the combustion system. The flue gases and entrained solids from a fluidized bed in the furnace section are separated and the flue gases are passed to a heat recovery section and the separated particulate material to the heat exchange section. The heat exchange section includes a bypass chamber for permitting the separated solids to pass directly from the separator, via an outlet chamber, to the furnace section. A heat exchange chamber is provided in the recycle heat exchange section which receives the separated materials from the bypass chamber and transfers heat from the separated material to a fluid flow circuit for heating the fluid flow circuit and reducing the temperature of the separated material. The separated material in the heat exchange chamber is then passed back, via the outlet chamber, to the furnace section.

16 Claims, 3 Drawing Sheets

FLUIDIZED BED COMBUSTION SYSTEM AND METHOD HAVING AN INTEGRAL RECYCLE HEAT EXCHANGER WITH A TRANSVERSE OUTLET CHAMBER

BACKGROUND OF THE INVENTION

This invention relates to a fluidized bed combustion system and a method of operating same and, more particularly, to such a system and method in which a recycle heat exchanger is formed integrally with the furnace section of the system.

Fluidized bed combustion systems are well known and include a furnace section in which air is passed through a bed of particulate material, including a fossil fuel, such as coal, and a sorbent for the oxides of sulfur generated as a result of combustion of the coal, to fluidize the bed and to promote the combustion of the fuel at a relatively low temperature. These types of combustion systems are often used in steam generators in which water is passed in a heat exchange relationship to the fluidized bed to generate steam and permit high combustion efficiency and fuel flexibility, high sulfur adsorption and low nitrogen oxides emissions.

The most typical fluidized bed utilized in the furnace section of these type systems is commonly referred to as a "bubbling" fluidized bed in which the bed of particulate material has a relatively high density and a well-defined, or discrete, upper surface. Other types of systems utilize a "circulating" fluidized bed in which the fluidized bed density is below that of a typical bubbling fluidized bed, the fluidizing air velocity is equal to or greater than that of a bubbling bed, and the flue gases passing through the bed entrain a substantial amount of the fine particulate solids to the extent that they are substantially saturated therewith.

Circulating fluidized beds are characterized by relatively high internal and external solids recycling which makes them insensitive to fuel heat release patterns, thus minimizing temperature variations and, therefore, stabilizing the sulfur emissions at a low level. The high external solids recycling is achieved by disposing a cyclone separator at the furnace section outlet to receive the flue gases, and the solids entrained thereby, from the fluidized bed. The solids are separated from the flue gases in the separator and the flue gases are passed to a heat recovery area while the solids are recycled back to the furnace. This recycling improves the efficiency of the separator, and the resulting increase in the efficient use of sulfur adsorbent and fuel residence times reduces the adsorbent and fuel consumption.

In the operation of these types of fluidized beds, and, more particularly, those of the circulating type, there are several important considerations. For example, the flue gases and entrained solids must be maintained in the furnace section at a particular temperature (usually approximately 1600° F.) consistent with proper sulfur capture by the adsorbent. As a result, the maximum heat capacity (head) of the flue gases passed to the heat recovery area and the maximum heat capacity of the separated solids recycled through the cyclone and to the furnace section are limited by this temperature. In a cycle requiring only superheat duty and no reheat duty, the heat content of the flue gases at the furnace section outlet is usually sufficient to provide the necessary heat for use in the heat recovery area of the steam generator downstream of the separator. Therefore, the heat content of the recycled solids is not needed.

However, in a steam generator using a circulating fluidized bed with sulfur capture and a cycle that requires reheat duty as well as superheater duty, the existing heat available in the flue gases at the furnace section outlet is not sufficient. At the same time, heat in the furnace cyclone recycle loop is in excess of the steam generator duty requirements. For such a cycle, the design must be such that the heat in the recycled solids must be utilized before the solids are reintroduced to the furnace section.

To provide this extra heat capacity, a recycle heat exchanger is sometimes located between the separator solids outlet and the fluidized bed of the furnace section. The recycle heat exchanger includes heat exchange surfaces and receives the separated solids from the separator and functions to transfer heat from the solids to the heat exchange surfaces at relatively high heat transfer rates before the solids are reintroduced to the furnace section. The heat from the heat exchange surfaces is then transferred to cooling circuits to supply reheat and/or superheat duty.

The simplest technique for controlling the amount of heat transfer in the recycle heat exchanger is to vary the level of solids therein. However, situations exist in which a sufficient degree of freedom in choosing the recycle bed height is not available, such as for example, when a minimum fluidized bed solids depth or pressure is required for reasons unrelated to heat transfer. In this case, the heat transfer may be controlled by utilizing "plug" valves or "L" valves for diverting a portion of the recycled solids so that they do not give up their heat in the recycle heat exchanger. The solids from the diverting path and from the heat exchanger path are then recombined, or each stream is directly routed to the furnace section, to complete the recycle path. In this manner, the proper transfer of heat to the heat exchanger surface is achieved for the unit load existing. However, these type arrangements require the use of moving parts within the solids system and/or need external solids flow conduits with associated aeration equipment which adds considerable cost to the system.

In order to reduce these costs, a system has been devised that is disclosed in U.S. application Ser. No. 371,170 filed on June 26, 1989 by the assignee of the present invention. According to this system, a recycle heat exchanger is provided for receiving the separated solids and distributing them back to the fluidized bed in the furnace section. The recycle heat exchanger is located externally of the furnace section of the system and includes an inlet chamber for receiving the solids discharged from the separators. Two additional chambers are provided which receive the solids from the inlet chamber. The solids are fluidized in the additional chambers and heat exchange surfaces are provided in one of the additional chambers for extracting heat from the solids. The solids in the additional chamber are permitted to flow into an outlet chamber when the level in the former chamber exceeds a predetermined height set by the height of an overflow weir. The solids entering the outlet chamber are then discharged back to the fluidized bed in the furnace section.

However, there are some disadvantages associated with this type of operation. For example, there is no dedicated structure for preventing the back-flow of separated solids from the furnace section to the outlet of the separator. Also, the space available for heat exchanger surfaces is limited, and pressure fluctuations in the furnace section are transmitted to the external heat exchanger which results in erratic performance. Also, the solids are directed from the heat exchanger through one discharge pipe to one relatively small area of the furnace section which is inconsistent with uniform mixing and distribution of the solids. Further, there is no provision for controlling the solids inventory, or furnace loading.

SUMMARY OF THE INVENTION

It is an object of the present invention to provide a fluidized bed combustion system and method which utilizes a recycle heat exchanger disposed integrally with the furnace section of the combustion system in which heat is removed from the separated solids before they are recycled back to the furnace.

It is a further object of the present invention to provide a system and method of the above type in which heat exchange surfaces are provided in the recycle heat exchanger to remove heat from the separated solids to control the furnace section temperature and provide additional heat to a fluid circuit associated with the system.

It is a further object of the present invention to provide a system and method of the above type in which heat is removed from the separated solids without reducing the temperature of the flue gases.

It is a further object of the present invention to provide a system and method of the above type in which the need for heat exchange surfaces in the heat recovery area of the combustion system is reduced.

It is a still further object of the present invention to provide a system and method of the above type in which the separated solids are prematurely fed from an upper area in the recycle heat exchanger downwardly through openings in a lower portion of a furnace wall so that a mixture of solids and air enters the furnace.

It is a still further object of the present invention to provide a system and method of the above type in which a relatively large space is available for the recycle heat exchanger surfaces.

It is a still further object of the present invention to provide a system and method of the above type in which the recycle heat exchanger includes a direct bypass chamber for routing the separated solids directly to the furnace section without passing over any heat exchange surfaces during start-up, shut-down, unit trip, and low load conditions.

It is a still further object of the present invention to provide a system and method of the above type in which a J-valve receives the separated solids from a separator and a direct connection is made from the J valve to the bypass chamber.

It is a still further object of the present invention to provide a system and method of the above type in which the recycle heat exchanger includes a transverse outlet chamber to insure a uniform distribution of the separated solids to the furnace section to increase the heat exchange efficiency.

Toward the fulfillment of these and other objects, the system of the present invention includes a recycle heat exchanger located adjacent the furnace section of the system. The flue gases and entrained particulate materials from the fluidized bed in the furnace section are separated, the flue gases are passed to a heat recovery area and the separated solids are passed to the recycle heat exchanger for transferring heat from the solids to fluid passing through the system. Heat exchange surfaces are provided in the heat exchanger for removing heat from the solids and a bypass passage is provided which is connected directly to a J-valve which receives the separated solids from the separator so that the solids pass through the bypass passage during start-up and low load conditions. A transverse outlet channel is provided in the heat exchanger for providing a uniform distribution and flow of the separated solids to the furnace section.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawing wherein.

DESCRIPTION OF THE PREFERRED EMBODIMENT

Figure 2:
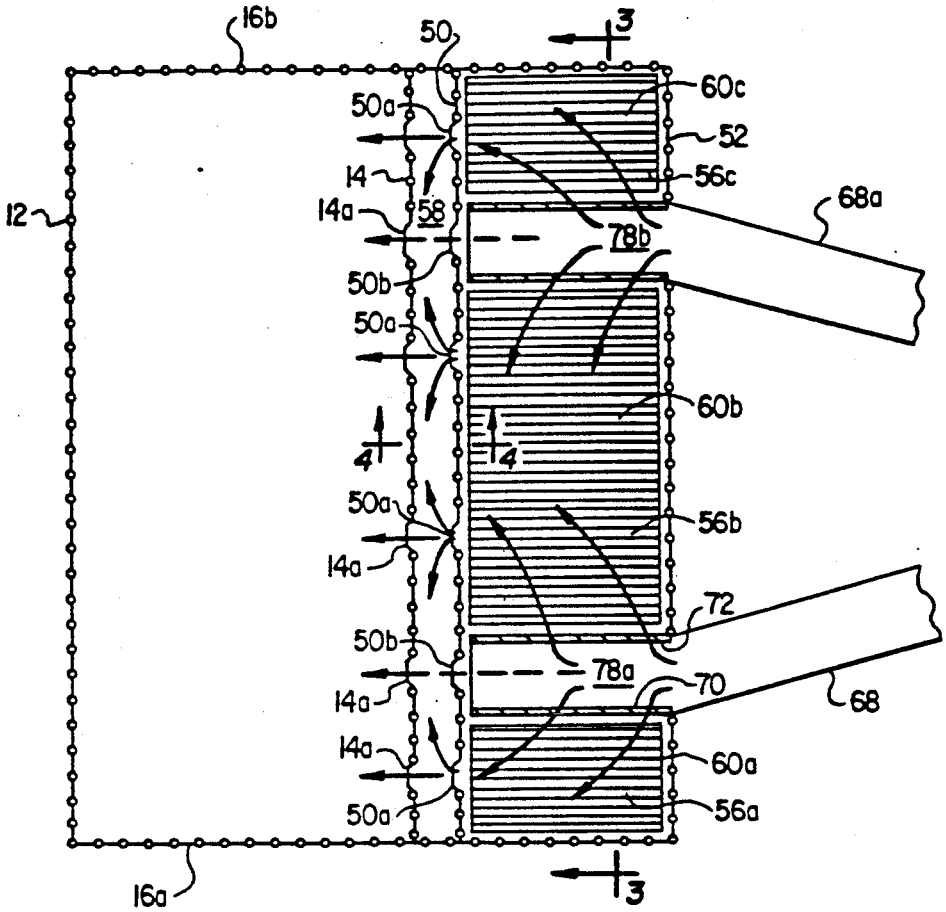
FIG. 2 is a partial cross-section, partial schematic view taken along the line 2—2 of FIG. 1.
Figure 3:
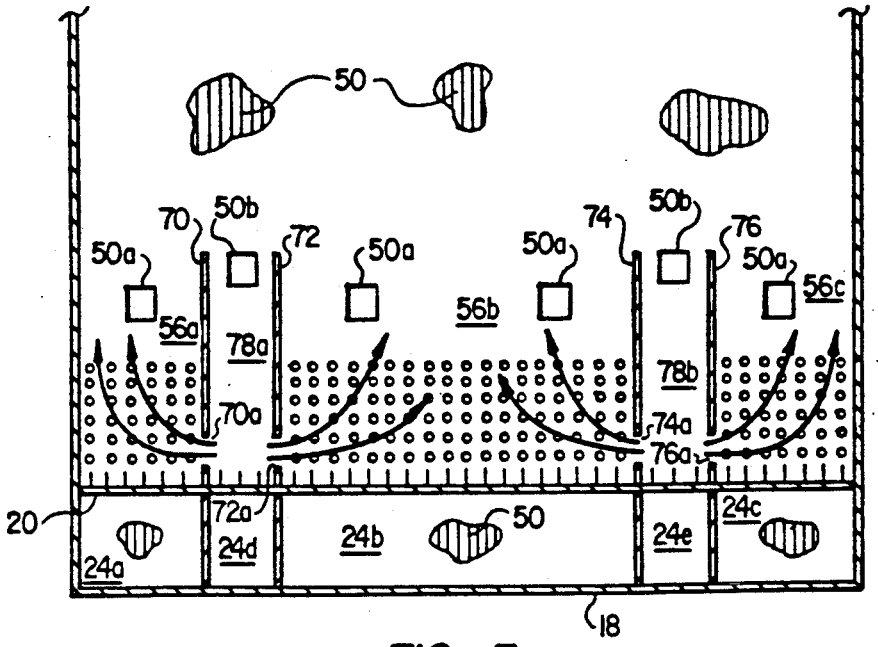
FIG. 3 is a cross-sectional view taken along the line 3—3 of FIG. 2.

The drawings depict the fluidized bed combustion system of the present invention used for the generation of steam and including an upright water cooled enclosure, referred to in general by the reference numeral 10, having a front wall 12, a rear wall 14 and two sidewalls 16*a* and 16*b* (FIGS. 2 and 3). The upper portion of the enclosure 10 is enclosed by a roof 17 and the lower portion includes a floor 18.

A plurality of air distributor nozzles 20 are mounted in corresponding openings found in a plate 22 extending across the lower portion of the enclosure 10. The plate 22 is spaced from the floor 18 to define an air plenum 24 which is adapted to receive air from external sources (not shown) and selectively distribute the air through the plate 22 and to portions of the enclosure 10, as will be described.

A coal feeder system, shown in general by the reference numeral 25, is provided adjacent the front wall 12 for introducing particulate material containing fuel into the enclosure 10. The particulate material is fluidized by the air from the plenum 24 as it passes upwardly through the plate 22. This air promotes the combustion of the fuel and the resulting mixture of combustion gases and the air (hereinafter termed "flue gases") rises in the enclosure by forced convection and entrains a portion of the solids to form a column of decreasing solids density in the upright enclosure 10 to a given elevation, above which the density remains substantially constant.

A cyclone separator 26 extends adjacent the enclosure 10 and is connected thereto via a duct 28 extending from an outlet provided in the rear wall 14 of the enclosure 10 to an inlet provided through the separator wall. Although reference is made to one separator 26, it is understood that one additional separator (not shown) is disposed behind the separator 26.

The separator 26 receives the flue gases and the entrained particle material from the enclosure 10 in a manner to be described and operates in a conventional manner to disengage the particulate material from the flue gases due to the centrifugal forces created in the separator. The separated flue gases, which are substantially free of solids, pass, via a duct 30 located immediately above the separator 26, into a heat recovery section shown in general by the reference numeral 32.

The heat recovery section 32 includes an enclosure 34 divided by a vertical partition 36 into a first passage which houses a reheater 38, and a second passage which houses a primary superheater 40. An economizer is provided and has an upper section 42*a* located in the above mentioned second passage and a lower section 42*b* in the lower portion of the heat recovery section 32. An opening 36*a* is provided in the upper portion of the partition 36 to permit a portion of the gases to flow into the passage containing the superheater 40 and the economizer sections 42*a* and 42*b*. The reheater 38, the superheater 40 and the economizer sections 42*a* and 42*b* are all formed by a plurality of heat exchange tubes extending in the path of the gases as they pass through the enclosure 34. After passing across the reheater 36, superheater 40 and the economizer sections 42*a* and 42*b* in the two parallel passes, the gases exit the enclosure 34 through an outlet 44.

Figure 1:
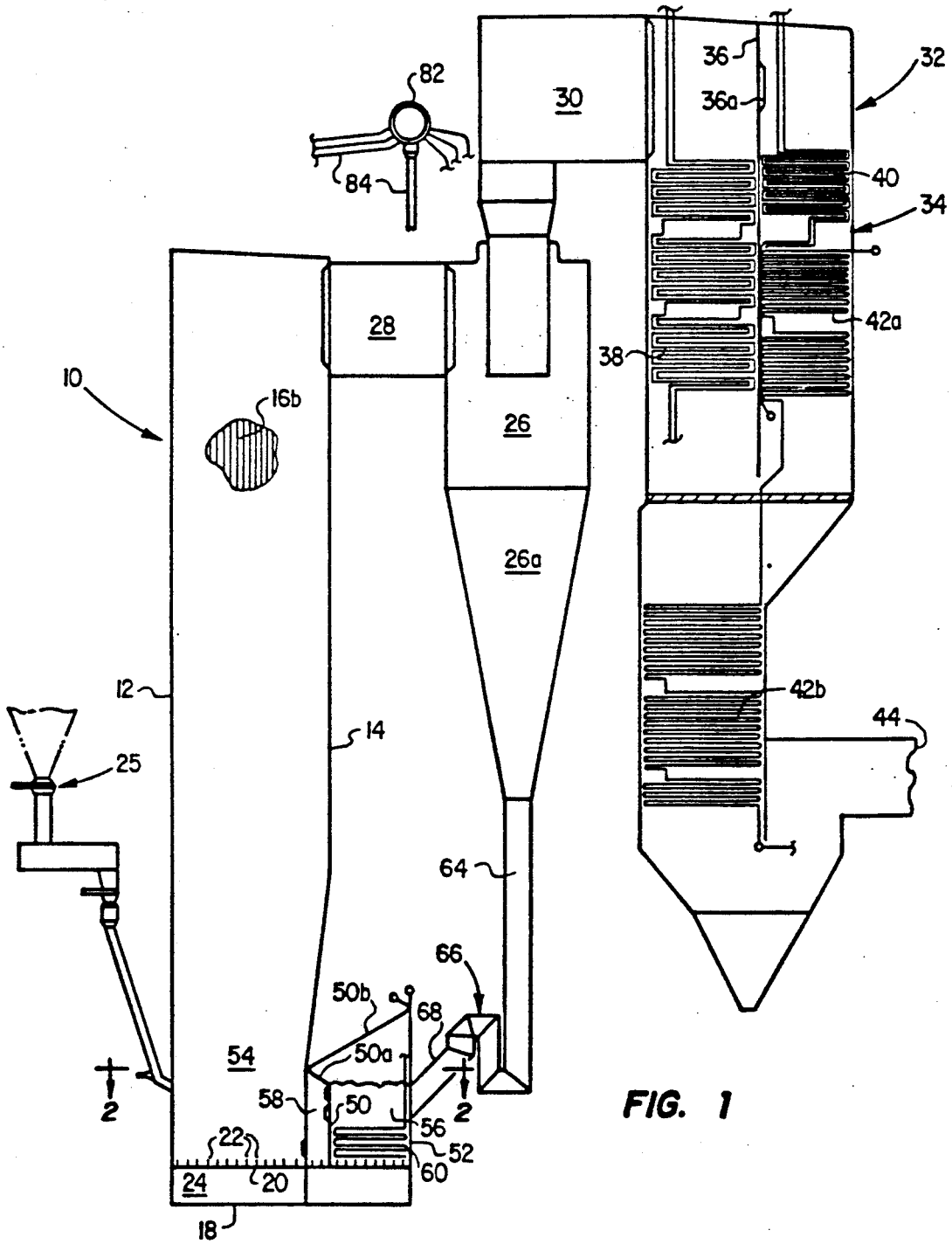
FIG. 1 is a schematic representation depicting the system of the present invention.

As shown in FIG. 1, the floor 18 and the plate 22 are extended past the rear wall 14 and a pair of vertically extending, spaced, parallel partitions 50 and 52 extend upwardly from the floor 18. The upper portion of the partition 50 is bent towards the wall 14, as shown by the reference 50*a*, to form a sealed boundary and then towards the partition 52, as shown by the reference 50*b*, with its upper end extending adjacent, and slightly bent back from, the latter wall, again forming a sealed boundary. Several openings are provided through the wall 14 and the partition 50 to establish flow paths for the solids, as will be described.

The front wall 12 and the rear wall 14 define a furnace section 54, the partitions 50 and 52 define a heat exchange section 56, and the rear wall 14 and the partition 50 define an outlet chamber 58. A plurality of heat exchange tubes 60 are disposed in the heat exchange section 56 and will be described in detail later.

The floor 18 and the plate 22 extend through the chamber 58 and the heat exchange section 56, and the extended portion of the plate 22 contains addition nozzles 20. Thus the plenum 24 also extends underneath the outlet chamber 58 and the heat exchange section 56 for introducing air to the nozzles 20 located therein in a manner to be described.

The lower portion of the separator 26 includes a hopper 26*a* which is connected to a dip leg 64 connected to an inlet "J" valve, shown in general by the reference numeral 66. An inlet conduit 68 connects the outlet of the J-valve 66 to the heat exchange section 56 to transfer the separated solids from the separator 26 to latter section, and the J-valve 66 functions in a conventional manner to prevent back-flow of solids from the furnace section 54 to the separator 26. The reference numeral 68*a* (FIG. 2) refers to the inlet conduit associated with the additional separator disposed behind the separator 26 but not shown in the drawings.

As shown in FIGS. 2 and 3, the heat exchange section 56 is formed into three compartments 56*a*, 56*b* and 56*c* by a first pair of transverse, spaced partitions 70 and 72 and by a second pair of similar partitions 74 and 76. A first bypass passage 78*a* is defined between the partitions 70 and 72, and a second bypass passage 78*b* is defined between the partitions 74 and 76. The heat exchange tubes 60 are divided into three spaced groups 60*a*, 60*b* and 60*c* respectively disposed in the compartments 56*a*, 56*b* and 56*c*; and openings 70*a*, 72*a*, 74*a* and 76*a* are provided in the lower portions of the partitions 70, 72, 74 and 76, respectively, for reasons to be described. The partitions 70, 72, 74 and 76 also divide the plenum 24 into three sections 24*a*, 24*b* and 24*c* extending immediately below the heat exchange compartments 56*a*, 56*b* and 56*c*, respectively and into two sections 24*d* and 24*e* extending below the bypass passages 78*a* and 78*b*. It is understood that means, such as dampers, or the like, (not shown) can be provided to selectively distribute air to the individual sections 24*a*, 24*b* and 24*c*.

Figure 4:
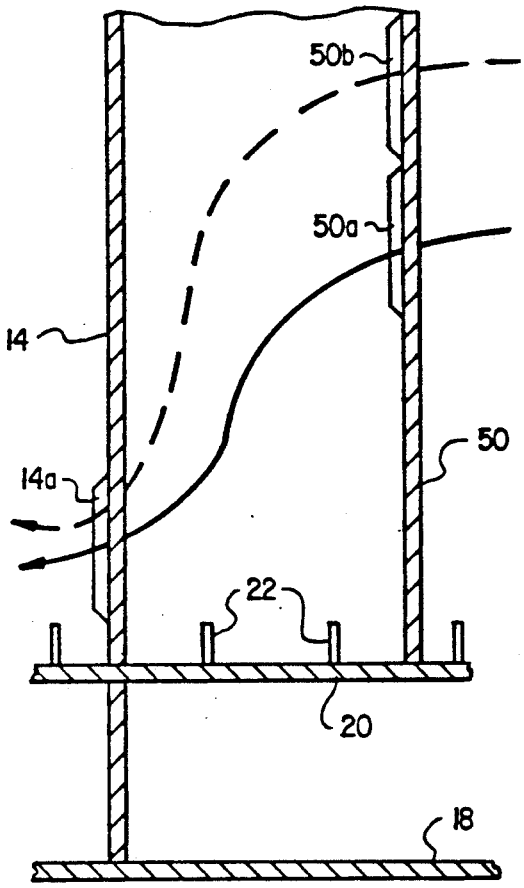
FIG. 4 is an enlarged sectional view taken along the line 4—4 of FIG. 2.

Four horizontally spaced openings 50*a* (FIGS. 2–4) are formed through the portion of those portions of the partition 50 defining the compartments 56*a*, 56*b* and 56*c*. An opening 50*b* is also formed in each of the portions of the partition 50 defining the bypass passages 78*a* and 78*b* and extend at an elevation higher than the openings 50*a* (FIGS. 3 and 4). Six spaced openings 14*a* (FIGS. 1, 2 and 4) are formed in the lower portion of the rear wall and extend below the openings 50*a* and 50*b*.

Figure 5:
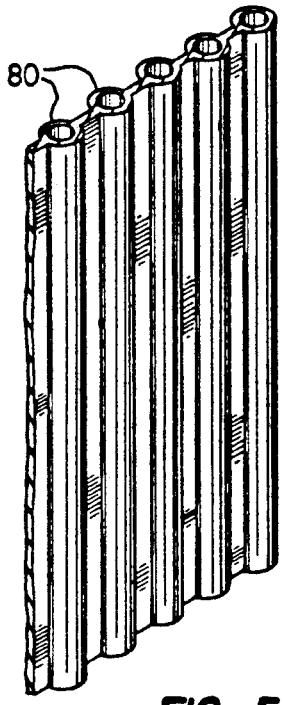
FIG. 5 is a partial, enlarged perspective view of a portion of a wall of the enclosure of the system of FIG. 1.

The front wall 12, the rear wall 14, the sidewalls 16*a* and 16*b*, the partition 50 the roof 17, and the walls defining the heat recovery enclosure 34 all are formed of membrane-type walls an example of which is depicted in FIG. 5. As shown, each wall is formed by a plurality of finned tubes 80 disposed in a vertically extending, air tight relationship with adjacent finned tubes being connected along their lengths.

A steam drum 82 (FIG. 1) is located above the enclosure 10 and, although not shown in the drawings, it is understood that a plurality of headers are disposed at the ends of the various walls described above. As shown in general by the reference numeral 84, a plurality of downcomers, pipes, etc. are utilized to establish a steam and water flow circuit through the tubes 80 forming the aforementioned water tube walls, with connecting feeders, risers, headers and the steam drum 82. The boundary walls of the cyclone separator 26, the heat exchanger tubes 60 and the tubes forming the reheater 38 and the superheater 40 are steam cooled while the economizer portions 42*a* and 42*b* receive feed water and discharge it to the steam drum 82. Thus, water is passed, in a predetermined sequence through this flow circuitry, including the downcomers and pipes 84, to convert the water to steam and heat the steam by the heat generated by combustion of the particulate fuel material in the furnace section 54.

In operation, particulate fuel material and a sorbent material (hereinafter referred to as "solids") are introduced into the furnace section 54 through the feeder system 25. Alternately, sorbent may also be introduced independently through openings in one or more of the furnace walls 12, 14, 16*a* and 16*b*. Air from an external source is introduced at a sufficient pressure into that portion of the plenum 24 extending below the furnace section 54 and the air passes through the nozzles 20 disposed in the furnace section 54 at a sufficient quantity and velocity to fluidize the solids in the latter section.

A lightoff burner (not shown), or the like, is provided to ignite the fuel material in the solids, and thereafter the fuel material is self-combusted by the heat in the furnace section 54. The mixture of air and gaseous products of combustion (hereinafter referred to as "flue gases") passes upwardly through the furnace section 54 and entrains, or elutriates, a majority of the solids. The quantity of the air introduced, via the air plenum 24, through the nozzles 20 and into the interior of the furnace section 54 is established in accordance with the size of the solids so that a circulating fluidized bed is formed, i.e. the solids are fluidized to an extent that substantial entrainment or elutriation thereof is achieved. Thus the flue gases passing into the upper portion of the furnace section 54 are substantially saturated with the solids and the arrangement is such that the density of the bed is relatively high in the lower portion of the furnace section 54, decreases with height throughout the length of this furnace section and is substantially constant and relatively low in the upper portion of the furnace section.

The saturated flue gases in the upper portion of the furnace section 54 exit into the duct 28 and pass into the cyclone separators 26. In each separator 26, the solids are separated from the flue gases and the former passes from the separators through the diplegs 64 and are injected, via the J-valves 66 and the conduits 68*a* and 60*b*, into the heat exchange section 56. The cleaned flue gases from the separator 26 exit, via the duct 30, and pass to the heat recovery section 32 for passage through the enclosure 34 and across the reheater 38, the superheater 40, and the economizer sections 42*a* and 42*b*, before exiting through the outlet 44 to external equipment.

With reference to FIGS. 2 and 3, the separated solids from the conduits 68 and 68*a* enter the passages 78*a* and 78*b*, respectively, in the heat exchange section 56 and pass, via the openings 70*a*, 72*a*, 74*a* and 76*a* in the partitions 70, 72, 74 and 76, respectively into the heat exchange compartments 56*a*, 56*b* and 56*c* as shown by the flow arrows. To promote this movement, air is introduced into the plenum sections 24*a*, 24*b* and 24*c* below the compartments 56*a*, 56*b* and 56*c*, respectively and is discharged into the latter compartments through the corresponding nozzles 20; while air flow into the plenum sections 24*d* and 24*e* is cut off. The air is of a sufficient quantity and velocity to fluidize the solids in the compartments 56*a*, 56*b* and 56*c* and drive the solids in a generally upwardly direction across the heat exchange tubes 60*a*, 60*b* and 60*c*, respectively, as shown by the flow arrows, before they exit, via the openings 50*a*, into the outlet chamber 58 defined between the rear wall 14 and the partition 50 as shown in FIG. 4. The solids mix in the chamber 58 as they pass downwardly through the latter chamber before passing through the lower openings 14*a* in the wall 14 and back to the furnace section 54.

It is understood that a drain pipe, or the like, may be provided on the plate 22 as needed for discharging spent solids from the furnace section 54 and the heat exchanger enclosure 56 as needed.

Feed water is introduced to and circulated through the flow circuit described above including the water wall tubes 80 and the steam drum 82, in a predetermined sequence to convert the feed water to steam and to reheat and superheat the steam. To this end, the heat removed from the solids in the heat exchanger 56 can be used to provide reheat and/or full or partial superheat. For example, the groups of tubes 60*a*, 60*b* and 60*c* can function to provide different stages of heating such as primary, intermediate and finishing superheating.

Since, during the above operation, there is no air introduced into or below the bypass passages 78*a* and 78*b* very little, if any, flow of solids occurs through the latter passages.

During initial start up and low load conditions the fluidizing air flow to the plenum sections 24*a*, 24*b* and 24*c* is turned off and the air flow to the sections 24*d* and 24*e* is turned on. As a result, the solids in the heat exchanger sections 56*a*, 56*b* and 56*c* slump and therefore seal this volume from further flow. Thus the solids from the conduits 68*a* and 68*b* pass directly through the bypass passages 78*a* and 78*b*, respectively and, through the openings 50*b*, into the outlet chamber 58. As in the previous mode, the solids mix in the chamber 58 before passing, via the openings 14*b* to the furnace section 54. Since the passages 78*a* and 78*b* do not contain heat exchanger tubes, start up and low load operation can be achieved without exposing the groups of tubes 60*a*, 60*b* and 60*c* to the hot recirculating solids.

Several advantages result in the system of the present invention. For example, heat is removed from the separated solids exiting from the separator 26 before they are reintroduced to the furnace section 54 without reducing the temperature of the separated flue gases. Also, the separated gases are at a sufficient temperature to provide significant heating of the system fluid while the recycle heat exchanger can function to provide additional heating. Further, the recycled solids can be passed directly from the J-valve 66 to the furnace section 54 during start-up or low load conditions prior to establishing adequate cooling steam flow to the tube groups 60*a*, 60*b* and 60*c*. Also, the heat exchanger section 56 is formed integrally with the furnace section 54 and operates at the same saturation temperature of the cooling fluid permitting the all welded boundary wall instruction as shown in FIG. 5. Also, the flow of separated solids back to the furnace can be achieved precisely and quickly by controlling the flow of fluidizing air from the plenum sections 24*a*, 24*b*, 24*c*, 24*d* and 24*f*. Further, a relatively large space is provided in the compartments 56*a* and 56*c* for accommodating the heat exchange tubes.

It is understood that several variations may be made in the foregoing without departing from the scope of the present invention. For example, the number of openings in the wall 14 and the partition 50 can vary in accordance with particular design requirements. Also, the heat removed from the solids in the heat exchanger section 56 can be used for heating the system fluid in the furnace section or the economizer, etc. and other types of beds may be utilized in the furnace, such as a circulating transport mode bed with constant density through its entire height or a bubbling bed, etc. Further, a series heat recovery arrangement can be provided with superheat, reheat and/or economizer surface, or any combination thereto. Also, the number and/or location of the bypass channels in the recycle heat exchanger can be varied and the number and size of separators used can be varied in accordance with the capacity of the steam generator and economic considerations. For example, three separators can be provided with a corresponding number of bypass channels which could be respectively located in the center and at the two ends of that portion of the enclosure housing the recycle heat exchanger.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fluidized bed combustion system comprising an enclosure; means defining a furnace section and a recycle heat exchange section in said enclosure; a fluidized bed formed in each of said sections; a separating section for receiving a mixture of flue gases and entrained particulate material from the fluidized bed in said furnace section and separating said entrained particulate material from said flue gases; a heat recovery section for receiving said separated flue gases; means for passing said separated material from said separating section to said recycle heat exchange section; means for dividing said recycle heat exchange section into a bypass compartment for directly receiving said separated material from said passing means, an outlet chamber, and an additional compartment, heat exchange means disposed in said additional compartment for removing heat from said separated material, means for selectively directing said separated material from said bypass compartment through said additional compartment to said outlet chamber or from said bypass compartment directly to said outlet chamber; and means connecting said outlet chamber to said furnace section for passing said separated material to said furnace section.

2. The system of claim 1 wherein said bypass compartment extends between said passing means and said outlet chamber, and said outlet chamber extends between said furnace section and both of said compartments.

3. The system of claim 1 wherein said directing means comprises means connecting said bypass compartment to said additional compartment and means connecting said bypass compartment and additional compartment to said outlet chamber.

4. The system of claim 3 wherein said dividing means comprises a plurality of partitions disposed in said enclosure.

5. The system of claim 4 wherein said connecting means comprises openings formed through said partitions.

6. The system of claim 1 wherein said directing means comprises means responsive to start-up and low load conditions for passing said separated material through said bypass compartment and directly to said outlet chamber, and means responsive to full-load conditions for passing said separated material from said bypass compartment, through said additional compartment and to said outlet chamber.

7. The system of claim 1 wherein said directing means comprises means for selectively introducing air to said bypass compartment or to said additional compartment to fluidize the separated material therein to permit the flow of said separated material through said bypass compartment directly to said outlet chamber or from said bypass compartment, through said additional compartment, and to said outlet chamber, respectively.

8. The system of claim 1 further comprising means for introducing air into said outlet chamber to fluidize the separated material in said chamber.

9. The system of claim 1 wherein at least a portion of the walls of said enclosure are formed by tubes, and further comprising fluid flow circuit means for passing fluid through said tubes to transfer heat generated in said furnace section to said fluid.

10. The system of claim 9 wherein said flow circuit means further comprises means for passing said fluid through said heat exchange means in a heat exchange relation to the separated material in said additional compartment to transfer heat from said separated material to said fluid.

11. The system of claim 1, wherein the separated material in said recycle heat exchange section seals against the backflow of material from said furnace section to said separating section.

12. A fluidized bed combustion method comprising the steps of forming a furnace section and a recycle heat exchange section in an enclosure, forming a bypass compartment and a heat exchange compartment in said recycle heat exchange section, fluidizing a bed of combustible material in said furnace section, discharging a mixture of flue gases and entrained material from said furnace section, separating said entrained material from said flue gases, passing said separated flue gases to a heat recovery section, passing said separated material into said bypass compartment, responding to full-load conditions for passing said separated material from said bypass compartment to said heat exchange compartment for removing heat from said separated material and then passing said material from said heat exchange compartment to said furnace section, and responding to start-up and/or low-load conditions for passing said separated material directly through said bypass compartment to said furnace section without removing heat from said separated material.

13. The method of claim 12 further comprising the step of passing said separated material through an outlet chamber in said recycle heat exchange section before the separated material is passed to said furnace section.

14. The method of claim 13 further comprising the step of fluidizing said separated material in said outlet chamber.

15. The method of claim 12 further comprising the step of establishing a fluid flow circuit including said recycle heat exchange section and water tubes forming at least a portion of the walls of said furnace section and said recycle heat exchange section, and passing fluid through said circuit to absorb heat from said furnace section and said recycle heat exchange section.

16. The method of claim 15 wherein said fluid is superheated as it passes through said recycle heat exchange section.

* * * * *

UNITED STATES PATENT AND TRADEMARK OFFICE

CERTIFICATE OF CORRECTION

PATENT NO. : 5,069,171

DATED : Dec. 3, 1991

INVENTOR(S) : Arthur M. Hansen, William D. Stevens, Justin P. Winkin

It is certified that error appears in the above-identified patent and that said Letters Patent is hereby corrected as shown below:

The Assignee should be : -- Foster Wheeler Energy Corporation
Clinton, N.J. --

Signed and Sealed this

Twenty-ninth Day of March, 1994

*Attest:*

Bruce Lehman

BRUCE LEHMAN

*Attesting Officer*

*Commissioner of Patents and Trademarks*